United States Patent [19]

Stanback et al.

[11] 4,293,153

[45] Oct. 6, 1981

[54] PANELBOARD VENT ASSEMBLY

[75] Inventors: Harris I. Stanback; Theodore L. Brann; Larry D. Polston, all of Lexington, Ky.

[73] Assignee: Square D Company, Palatine, Ill.

[21] Appl. No.: 36,954

[22] Filed: May 7, 1979

[51] Int. Cl.[3] ..... E05C 19/06

[52] U.S. Cl. ..... 292/85; 292/91

[58] Field of Search ..... 292/DIG. 16, DIG. 65, 292/85, 87, 82, 81, 91

[56] References Cited

U.S. PATENT DOCUMENTS

| | | | |
|---|---|---|---|
| 230,476 | 7/1880 | Green | 292/85 |
| 1,235,075 | 7/1917 | Stamm | 292/85 |
| 3,334,770 | 8/1967 | Stanback | 292/87 X |
| 3,338,612 | 8/1967 | Howard | 292/DIG. 16 |
| 4,057,271 | 11/1977 | Colinet | 292/87 |

*Primary Examiner*—Richard E. Moore

*Attorney, Agent, or Firm*—Larry I. Golden; Norton Lesser; Richard T. Guttman

[57] ABSTRACT

A spring steel spring interlocked with a panelboard assembly door by a pull having a leg projecting through the door to engage a passage edge in the spring. When the pull is rotated to open the door the leg moves the spring to disengage a latch adjacent one end of the spring from behind a detent in a frame latch passage. The detent in the frame passage engages the latch to hold the door from rapid opening, if a circuit breaker trips to generate arc gases which exert pressure against the door, but permits separation of the door from the frame and flexure of the door to vent arc gases.

10 Claims, 9 Drawing Figures

PANELBOARD VENT ASSEMBLY

FIELD OF THE INVENTION

The present invention relates in general to latched door enclosures subject to internal gas pressure and more particularly to an improved panelboard vent assembly for use in economical panelboards.

SUMMARY OF THE PRIOR ART

Panelboard assemblies incorporate a cabinet, which houses a plurality of circuit breakers each connected to a respective bus bar. The circuit breakers are disposed behind an interior trim and their handles project through the interior trim for access thereto.

The interior trim is overlapped by a door, which is opened to provide access to the circuit breaker handles. In order to latch the door closed, the more economical panelboard cabinet doors may utilize a single sheet metal spring detent or latch operated by a pull for engagement with and disengagement from an edge of the associated door frame. Latches for panelboard cabinet doors of a similar type are shown in U.S. Pat. Nos. 2,761,716 and 3,334,770.

The tripping of one of the circuit breakers in the cabinet may give rise to a volume of hot expanding ionized gas creating pressure against the latched door to open the door since the latch can yield relatively easily to the pressure. The door may thus blow open with considerable force and injure nearby personnel, while the sudden release of a large volume of hot ionized gas may also create a hazard.

In view of this situation regulatory and/or testing agencies have instituted a requirement that the panelboard doors open no more than 60°, when subject to the gas pressure occurring from tripping of an enclosed circuit breaker. Providing a panelboard door with the required variety of functions under these conditions can of course add considerable expense to a panelboard assembly.

SUMMARY OF THE INVENTION

To solve the problem of holding a door latched closed by an economical latch from opening fully, when subject to arc gas pressure, the present invention employs a simple pair of shoulders on a spring steel latch of a type similar to that used in economical panelboards for engaging a pair of detents formed in a latch passage of the door frame. The shoulders engage the detents in response to opening movement of the door resulting from arc gas pressure to hold the door closed. Some bending or warpage of the light sheet metal door from the frame then permits venting of the gas.

Normal opening of the door is provided by a ring like pull that interlocks the latch and door and has a simple leg moving the spring latch to disengage the shoulders from the detents and enable facile movement of the door to an open position.

Accordingly it is one object of the present invention to provide a more economical vent assembly for the enclosure of a circuit interrupting device.

It is another object to provide an economical panelboard latch assembly enabling for venting of a panelboard.

Other objects and features of the present invention will become apparent on examination of the following specification including the claims and accompanying drawings.

DESCRIPTION OF THE PREFERRED EMBODIMENT

Figure 1:
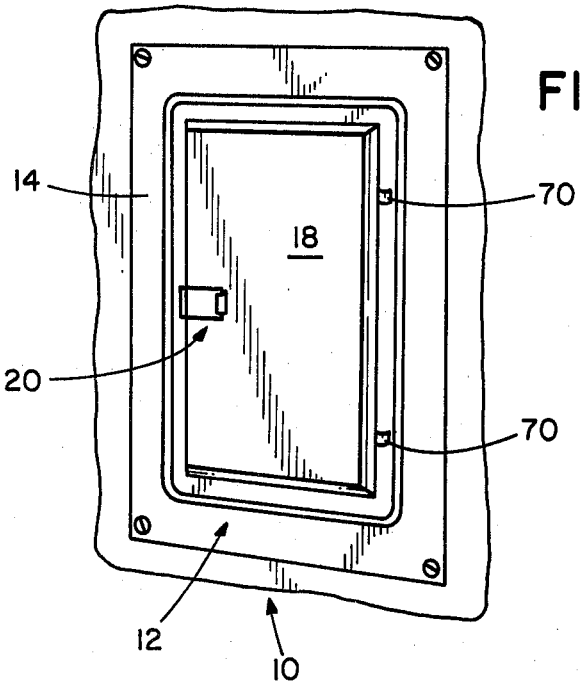
FIG. 1 is an isometric view of a panelboard incorporating the principles of the present invention.
Figure 4A:
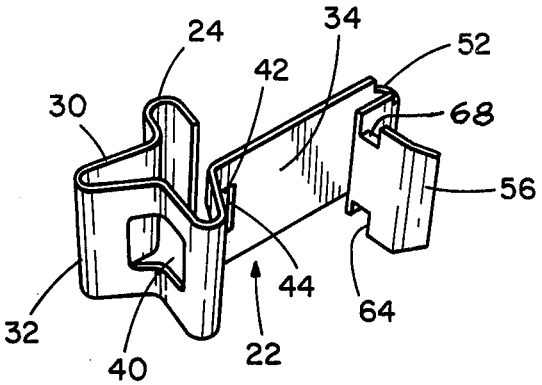
FIG. 4*a* is an isometric view of the latch member.

In FIG. 1 of the drawings a panelboard assembly is indicated by the reference character 10. The panelboard assembly 10 comprises a cabinet 12 such as shown in one of the aforementioned patents or as shown in a publication entitled QO Circuit Breakers and Load Centers copyright 1977 by the Square D Company.

The cabinet 12 has a trim plate or cover 14 with a recessed portion 16 surrounded by a frame 17 to define an opening. The opening is adapted to be closed by a door 18 hingedly mounted on the cover 14 along one edge when the door closing edge is moved to overlappingly engage the door frame 17. When the door is moved to an open position access is provided to one or more circuit breaker handles extending through the interior trim.

The door 18 carries a latch assembly 20. The latch assembly 20 includes an elongate planar spring steel member or latch 22 having an open fold 24 projecting through passage 26 in the door and located adjacent the closing door edge, as may be seen from FIGS. 2, 3, 4, 7 and 8.

A pull or handle 28 in the form of a split ring is received between the two arms of the fold 24. The pull 28 extends past opposite edges of passage 26 to overlap the outer face of door 18 and a planar leg 30 at one end of fold 24 engages the inner surface of door 18 to thereby secure the latch assembly 20 to the door.

Leg 30 extends in a direction from the adjacent door closing edge toward the door hinged edge for substantially ½". A reverse bend 32 at the end of leg 30 extends the latch member 22 along a main body portion or planar leg 34 toward the door closing edge. An open fold 36 is formed in leg 34 intermediate the ends of leg 34. Fold 36 extends in the opposite direction from fold 24 and is offset from fold 24 in the direction of bend 32 with the open end of fold 36 facing in the direction of the open end of fold 24 to receive a leg 38 projecting through passage 26 from one of the split ends of pull 28.

The leg 38 projects at an angle of substantially 60° from the plane of the ring forming pull 28 and when the pull projects toward the door closing edge, the leg 38 extends in the direction of fold 36. A passage 40 located in the rear leg of fold 36 serves to facilitate spring flexure in the area. A passage 42 is also provided in the front leg of fold 36 to accommodate the leg 38 in response to rotation of the pull 28 and passage 42 extends into the planar portion of leg 34 to provide an end edge 44 transverse or perpendicular to the rotational path of leg 38, for rotating the latch to move the leg 34 together with a detent or main latch portion 46 of member 22 towards the door closing edge or frame as may be best seen from FIG. 3, 4, 7 and 8.

The leg 34 extends through a passage 48 in an offset portion 50 of the door. A reduced section reverse bend 52 at the free end of leg 34 passes through a reduced section passage 53 formed in the edge of a planar closing edge portion of door 18 to interlock the door and latch assembly against movement in one direction perpendicular to the longitudinal axis of leg 34. The reduced section 52 resiliently connects the body portion 34 to latch portion 46 A leg 54 is formed at the free end of bend 52 and is offset from leg 34 in the direction of frame 17 and main latch portion 46 is formed on the free end of leg 54. Latch portion 46 extends transverse to the leg 54 in the direction of frame 17 and has a bent cam or nose 56 for registry and receipt in a wide portion of a keeper or latch passage 58 formed in frame 17.

The keeper passage 58 has a pair of shoulders or detents 60 extending therein to form a narrow passage portion 62 located in the portion of passage 58 extending in the direction of the door hinge edge. The shoulders 60 have one edge for engaging nose 56 to cam the latch portion 46 to interlockingly engage with a respective shoulder 64 formed by a reduced section portion between leg 54 and latch portion 46.

The member 22 is assembled to the door by moving fold 24 through passage 26 after passing leg 34 through passage 48 and then bend 52 is engaged with reduced section passage 53. Leg 38 of pull 28 is forced under the free end of fold 24 against the pressure of bend 32 with the leg 38 directed toward passage 42 to enable the split segment of pull 28 to be received between the arms of fold 24. At that time the pull 28 extends toward the door closing edge and leg 38 is pivoted into position adjacent passage 40 while reverse bend 32 applies pressure against the inner surface of door 18 to move fold 24 toward passage 26 and hold the split segment on leg of pull 28 against the door outer surface to interlock the member 22 with the pull 28 and the door.

To close the door 18, the door is simply pivoted toward a closing position and the nose 56 of latch 46 engages the edge of detents 60 in the door frame 17 to move the latch through passage 58 until the door is closed, at which time the detents 60 are received between leg 54 and shoulders 64. This interlocks the latch and frame for holding the door closed. A pair of short ears 68 extend from the reduced section between leg 54 and shoulders 64 in a direction transverse to the plane of shoulders 64 to aid engagement in the event of misalignment.

Figure 3:
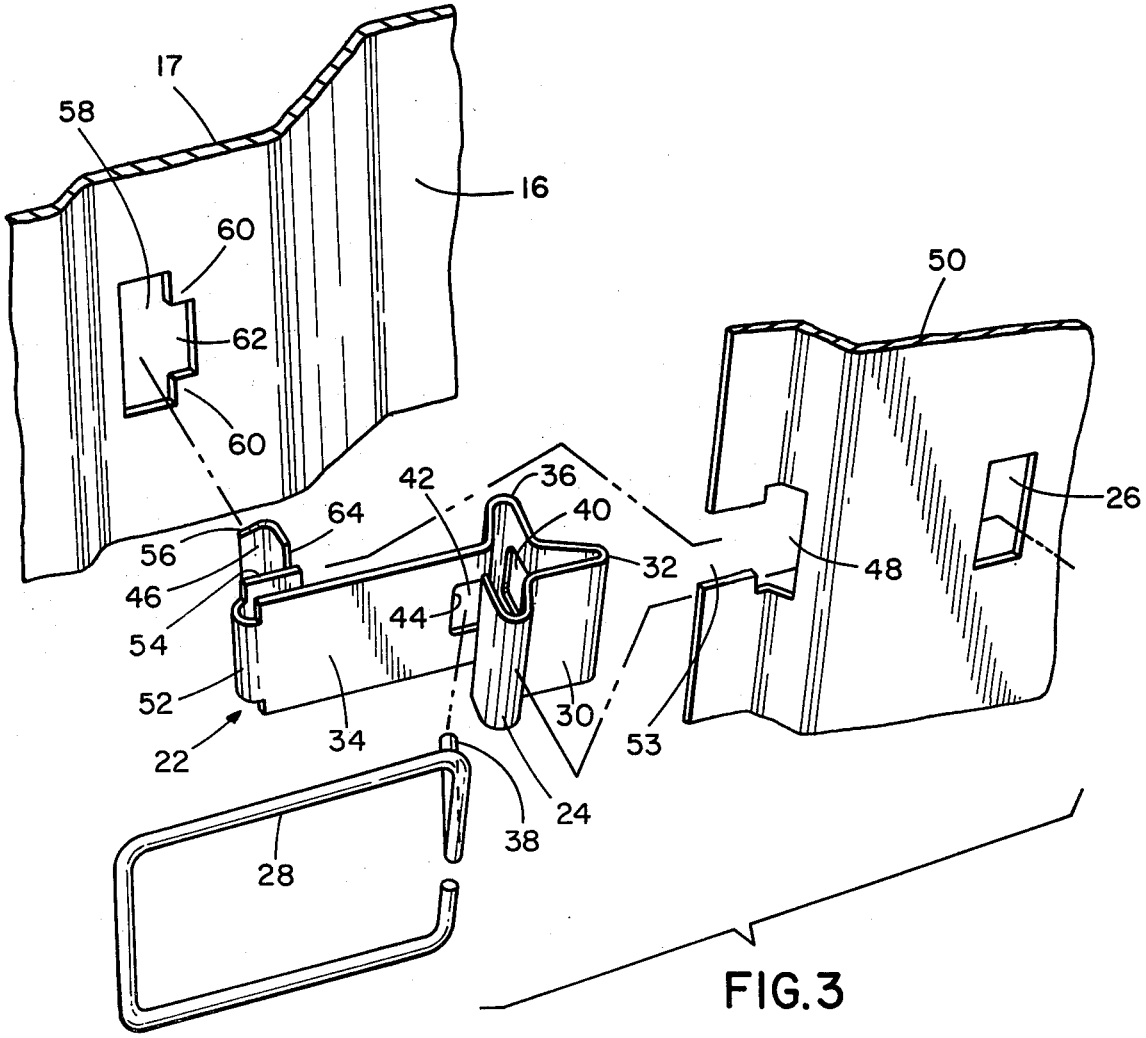
FIG. 3 is an exploded isometric view of the latch assembly incorporating the principles of the present invention.
Figure 2:
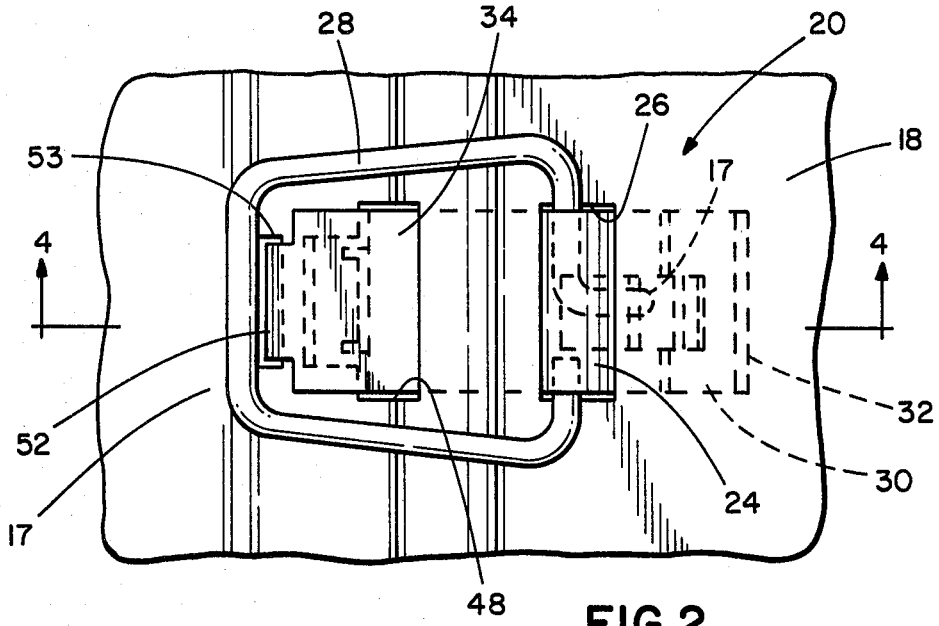
FIG. 2 is a fragmentary front elevational view of the relevant portion of the panelboard shown in FIG. 1.
Figure 4:
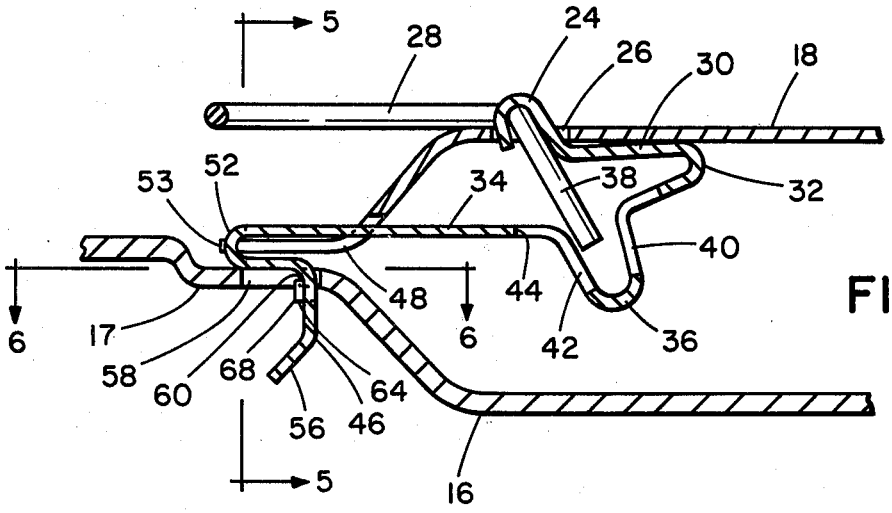
FIG. 4 is a sectional view taken through the line 4—4 in FIG. 2.
Figure 5:
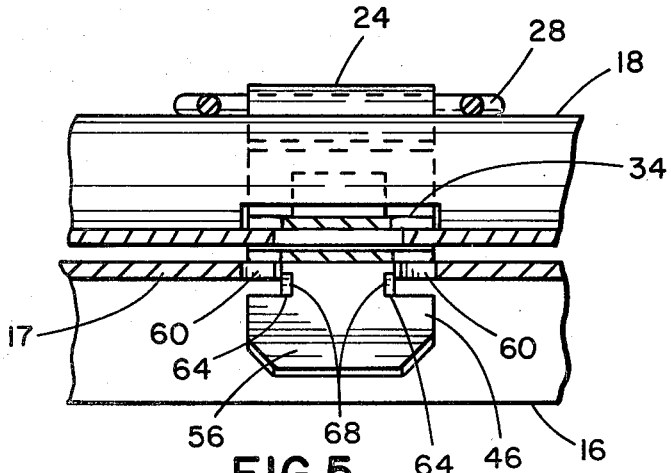
FIG. 5 is a sectional view taken through the line 5—5 in FIG. 4.
Figure 6:
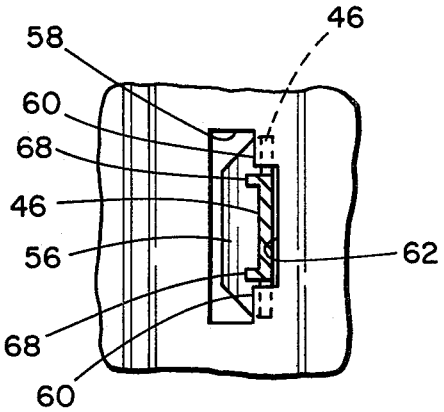
FIG. 6 is a sectional elevational view taken through the line 6—6 in FIG. 4.

If a circuit breaker in the cabinet 12 and located behind the interior trim or frame indicated generally at 16 in FIG. 3, should trip in response to a fault current, the arc gasses may generate considerable pressure against the door 18. As the door 18 pivots about its hinges indicated at 70 in FIG. 1, the shoulders 64 on the latch portion 46 attempt to move therewith, but engage the detents 60, which limit the opening movement of the door, as may best be seen in FIG. 8. Since the spring 22 flexes at the reduced section 52 some opening movement occurs and space is provided between the door and frame to vent the gas in addition to any venting provided by the normal flexure of the light sheet metal door from the frame between shoulders 64 and the hinges under the applied pressure.

Figure 7:
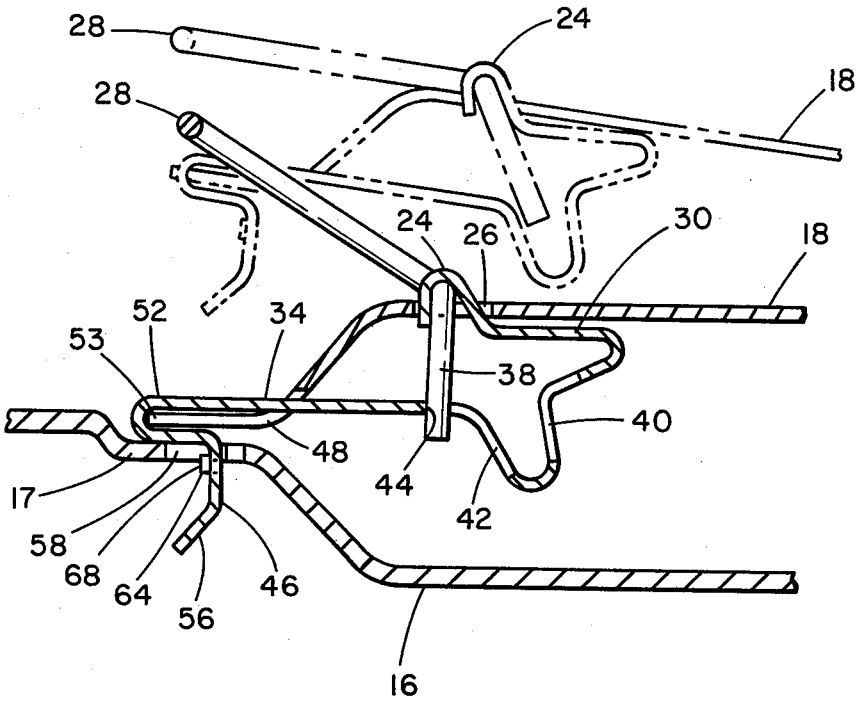
FIG. 7 is a sectional view showing the latch assembly in door releasing position, and illustrating by dashed lines, the partially open door.
Figure 8:
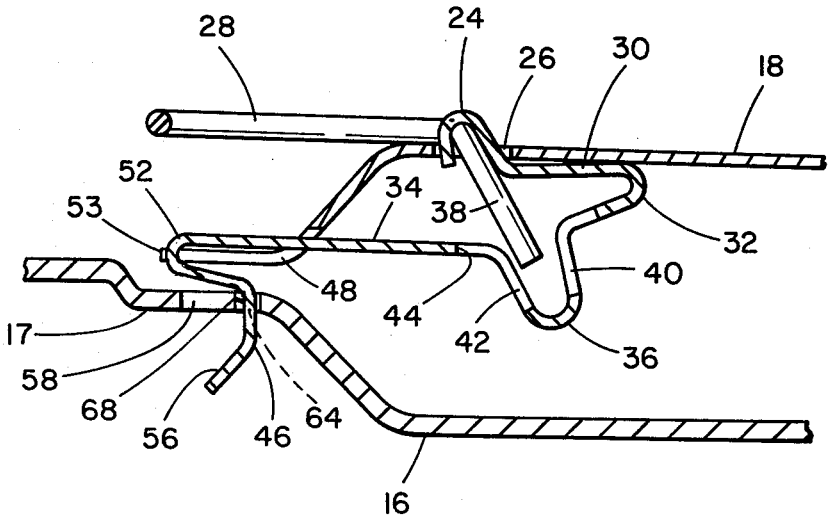
FIG. 8 is a sectional view illustrating the manner in which the latch assembly responds to elevated internal gas pressure.

To open the door 18 normally, the pull 28 is pivoted about the axis of the ring segment in fold 24 to engage leg 38 with the edge 44 of passage 42 as best seen in FIG. 7 to move leg 34 to the left as the bend 32 and fold 36 flex to accommodate the pressure against edge 44. As leg 34 moves toward the passage 58, shoulders 64 on the latch portion are disengaged from behind detents 60 and are aligned with passage 58 to permit the latch portion to be disengaged from the frame 17 and the door opened as indicated by the dashed lines in FIG. 7. The door may now be simply pivoted to an open position. It will be appreciated that the pull 28 is operated in a similar fashion on a closing operation if desired.

The member 22 is formed of spring steel substantially 0.035" thick and 0.62 wide so that while the material is capable of the necessary flexure, sufficient rigidity is provided at shoulders 64 to resist opening pressure of the arc gasses. Leg 38 is substantially 0.5" long while the opposing segment of pull 28, which is manually grasped, is substantially 1" from the segment passing through fold 24 to thereby provide a desirable mechanical advantage when leg 38 engages edge 44.

The foregoing is a description of an improved panelboard door lock assembly, whose inventive concepts are believed set forth in the accompanying claims.

I claim:

1. An improved vent assembly for an enclosure including a door pivotally supported on said enclosure adjacent one edge of said door to move another edge of said door to a closed position and to an open position to enable access to a circuit interrupting device in said enclosure, said device generating arc gases exerting pressure for moving said door from said closed position to said open position in response to a fault current passing through said device, the improvement comprising:

an elongate planar spring steel member assuming a serpentine configuration and having a main body portion, a projecting main latch portion and a resilient bend having a reduced cross section from said main body portion resiliently connecting said latch portion to said body portion, said main latch portion having a latch shoulder located between said main latch portion and said body portion;

support means for supporting said member in a first position on said door with said latch portion located adjacent said other edge and projecting toward said enclosure in response to the movement of said other edge to said closed position;

means for optionally moving said latch portion towards said other edge, said spring member automatically returning said latch portion to said first position;

a latch passage in said enclosure with said latch passage spaced for receiving said latch portion in response to movement of said other edge to a closed position; and detent means located between said latch passage and said one door edge for interlocking engagement between said latch shoulder and body portion in response to the engagement of said latch portion in said latch passage with said member in said first position, said latch portion including a nose in camming relationship with said detent means urging said latch portion towards said other edge and aligning said latch with said latch passage in response to movement of said other edge to a closed position, said latch being received by said passage upon movement of said other edge to a closed position and said latch automatically returning to said first position whereby said latch shoulder engages said detent means, said resilient latch portion adapted to flex to provide limited movement of said door from said closed position in response to the generation of a predetermined amount of pressure caused by said arc gases whereby venting of said gases is accomplished.

2. An improved vent assembly for an enclosure including a door pivotally supported on said enclosure adjacent one edge of said door to move another edge of said door to a closed position and to an open position to enable access to a circuit interrupting device in said enclosure, said device generating arc gases exerting pressure for moving said door from said closed position to said open position in response to a fault current passing through said device, the improvement comprising:

a spring steel member having a latch portion projecting from said member and having a latch shoulder located between said latch portion and member, support means for supporting said member on said door with said latch portion located adjacent said other edge and projecting toward said enclosure in response to the movement of said other edge to said closed position, means for optionally moving said member and latch portion towards said other edge and automatically retracting said latch portion and member from said other edge, and a latch passage for said enclosure with said latch passage spaced for receiving said latch portion in response to movement of said other edge to a closed position and having detent means located between said latch passage and said one door edge for interlocking engagement between said latch shoulder and member in response to the engagement of said latch portion in said latch passage and the automatic retraction of said latch portion from said other edge for limiting movement of said door from said closed position in response to the generation of said arc gases, said support means comprising a pull engaged with one surface of said door, a portion of said member extending through said door and overlapping said pull.

3. In the assembly claimed in claim 2, means integral with said member engaged with the other surface of said door for applying spring pressure to retract said portion through said door.

4. In the assembly claimed in claim 3 in which said member has a planar portion extending through said door toward said door other edge and reverse bend intermediate said planar portion and said latch portion for engaging a closing edge portion of said door.

5. The assembly claimed in claim 2 in which said pull is ring like and the portion of said member extending through said door comprises a fold overlapping a segment of said pull.

6. The assembly claimed in claim 5 in which said means for optionally moving said member comprises a leg on said pull extending through said door, and an edge portion on said member engaged by said leg in response to rotation of said pull.

7. An improved vent assembly for an enclosure including a door pivotally movable to a closed position overlapping a frame and movable to an open position to enable access to a circuit interrupting device in said enclosure, said device generating arc gasses exerting pressure for moving said door from said closed position to said open position in response to a fault current passing through said device, the improvement comprising:

a sheet metal member having a pivot fold projecting in one direction from said member and a deflectable latch projecting in another direction from said member with a reduced section between said latch and member, a door passage in said door for receiving said fold, a pull having one segment captured between said fold and door for pivoting movement about an axis of said segment and engaging one surface of said door to interlock said member, said ring and said door with each other, a latch passage in said frame receiving said latch in response to movement of said door to a closed position and having edge means for interlocking engagement with said reduced section in response to the engagement of said latch in said latch passage for preventing movement of said door to an open position in response to the generation of said arc gases, and a leg on said pull extending through said door passage for engagement with said sheet metal member to move said sheet metal member in one direction in response to rotation of said ring member in a respective direction to disengage said reduced section from interlocking engagement with said edge means.

8. The vent assembly claimed in claim 7, spring means integrally formed on said member for holding said pull engaged with said door and for moving said reduced section in a direction opposite said one direction.

9. An improved vent assembly for an enclosure including a door pivotally movable along an arc having an axis of rotation to a closed position overlapping a frame and pivotable along said arc to an open position to enable access to a circuit interrupting device in said enclosure, said device generating arc gasses exerting pressure for moving said door from said closed position to said open position in response to a fault current passing through said device, the improvement comprising:

a sheet metal member having a deflectable latch projecting from said member with shoulder means between said latch and member, means for mounting said member on said door with said latch projecting transverse to said door and said shoulder means adapted to move along an arc having a predetermined radial distance from said axis of rotation, a latch passage in said frame receiving said latch in response to movement of said door to a closed position and having edge means located a greater distance from said axis of rotation than said predetermined distance for interlocking engagement with said shoulder means in response to the engagement of said latch in said latch passage for limiting movement of said door from said closed passage in response to the generation of said arc gasses, manually operable means for deflecting said latch and shoulder means from said edge means for enabling movement of said latch through said latch passage, and flexing means for enabling said latch to flex for enabling partial opening of said door in response to the generation of arc gases while said shoulder means are interlocked with said edge means.

10. The vent assembly claimed in claim 8, in which said flexing means includes a reduced section on said latch facilitating yielding of said member in a direction transverse to a radial line from said axis for enabling separation of said door from said frame to enable venting of said gasses.

* * * * *